United States Patent [19]

Suba

[11] 4,276,669

[45] Jul. 7, 1981

[54] AUTOMATICALLY-INFLATABLE LIFE PRESERVER

[76] Inventor: Virgilio Suba, 1050 Campbell Ave., Detroit, Mich. 48209

[21] Appl. No.: 871,176

[22] Filed: Jan. 23, 1978

[51] Int. Cl.[2] ..... B63C 9/20

[52] U.S. Cl. ..... 9/313; 9/319

[58] Field of Search ..... 9/11 A, 311, 312, 313, 9/314, 316, 319, 321, 322, 329, 336, 338, 339; 137/447; 116/107, 108, 110, 139, 142 FP

[56] References Cited

U.S. PATENT DOCUMENTS

| | | | |
|---|---|---|---|
| 380,860 | 4/1888 | Chambers | 137/447 X |
| 1,849,637 | 3/1932 | Peternella | 9/319 X |
| 2,774,979 | 12/1956 | Moran | 9/316 |
| 2,895,147 | 7/1959 | Desjarlais et al. | 9/319 |
| 3,147,499 | 9/1964 | Nelson et al. | 9/313 |
| 3,228,045 | 1/1966 | Shepherd et al. | 9/338 X |
| 3,324,816 | 6/1967 | Vogelsang | 9/321 X |
| 3,877,098 | 4/1975 | Braly | 9/313 |
| 3,942,468 | 3/1976 | Olofsson | 116/142 FP |

FOREIGN PATENT DOCUMENTS

| | | | |
|---|---|---|---|
| 2604943 | 8/1976 | Fed. Rep. of Germany | 9/321 |

*Primary Examiner*—Trygve M. Blix

*Assistant Examiner*—Winston H. Douglas

[57] ABSTRACT

A flexible flotation envelope is detachably secured to a belt encircling the wearer's chest beneath his armpits. Adapted to be supported on the user's back with its lower end connected to the belt is a container for a vertical compressed air or oxygen flotation gas supply tank or cylinder provided at its upper end with a rotary gas distribution valve. The valve contains a rotary valve member rotatable between open and closed positions respectively opening and closing gas flow through the valve to the envelope and having its opposite ends connected to the inner ends of parallel valve-operating lever arms, the outer ends of which are connected to the opposite ends of a valve-operating float. A flexible tube extends from the valve casing to the envelope by way of one arm of a Y fitting, from the other arm of which runs a flexible tube to an alarm whistle by way of a flexible inflatable bladder. Shoulder straps are connected to the upper end of the compressed gas tank container and are adapted to pass over the shoulders of the wearer to the front of the belt. Optional manual rotation of the rotary valve member is provided by wearer-operated flexible cords extending backward over the user's shoulders to the lever arms adjacent the float.

1 Claim, 5 Drawing Figures

FIG. 1
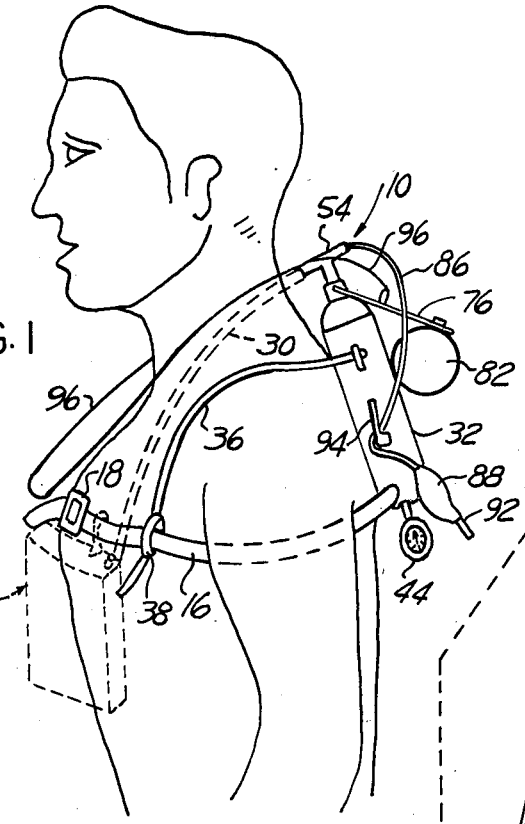
FIG. 3
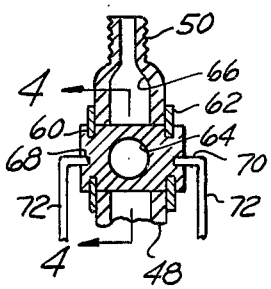
FIG. 4
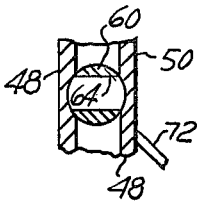
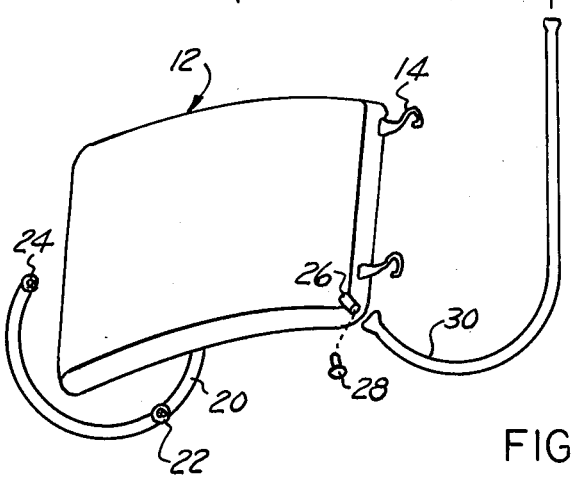
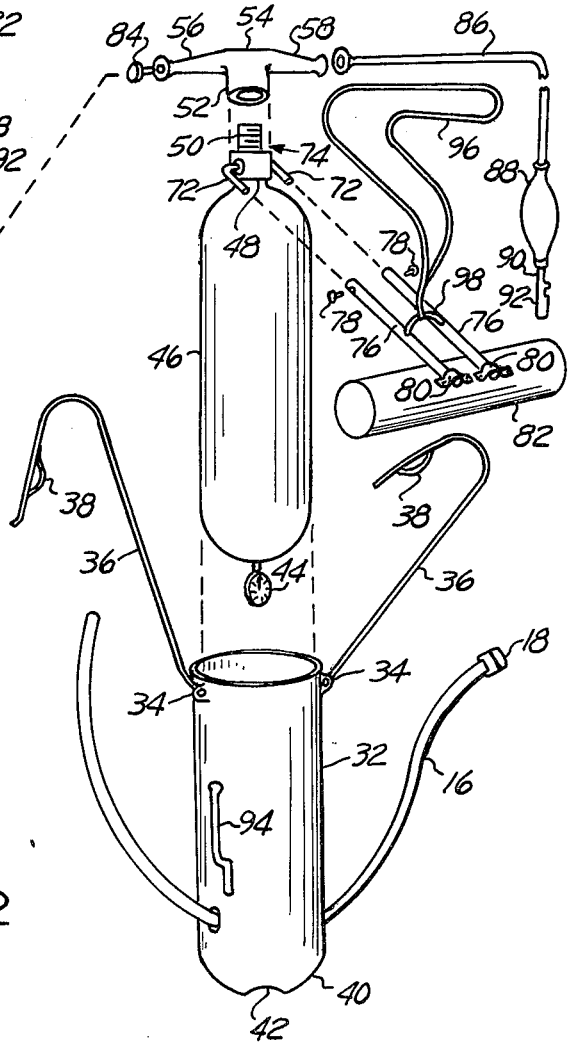
FIG. 2
FIG. 5
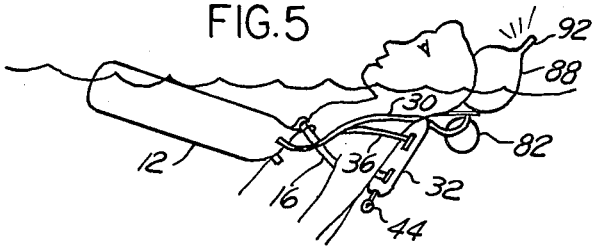

AUTOMATICALLY-INFLATABLE LIFE PRESERVER

SUMMARY OF THE INVENTION

This invention principally resides in the float-operated rotary valve which normally shuts off the supply of the compressed gas, such as air or oxygen, from the compressed gas tank to the flotation envelope but which opens automatically when the device is immersed in water, yet which is also operable manually. This invention also resides in the provision of a flexible bladder connected to an alarm whistle.

In the drawing,

FIG. 1 is a side elevation of the automatically-inflatable life preserver, according to a preferred form of the invention, as mounted upon the back and shoulders of the wearer, with the detachable flotation envelope and its inflation tube indicated by broken lines;

FIG. 2 is an exploded perspective view of the automatically-inflatable life preserver as set forth in FIGS. 1 and 5 showing the invention upon an enlarged scale with the connection of the inflating tube of the flotation envelope to the Y-fitting atop the rotary valve and of the valve-operating lever arms shown in broken lines;

FIG. 3 is a longitudinal section upon an enlarged scale, through the rotary gas distribution valve in its dormant closed position;

FIG. 4 is a longitudinal section through the rotary valve member of the rotary gas distribution valve, taken along the line 4—4 in FIG. 3; and FIG. 5 is a side elevation, upon a reduced scale, of the automatically-inflatable life preserver of FIGS. 1 and 2, showing it supporting a user in the water.

Referring to the drawing in detail, FIG. 1 shows an automatically-inflatable life preserver, generally designated 10, mounted on the shoulders of a wearer, the life preserver 10 being in its dormant or inactive position. The life preserver 10 includes an inflatable flotation envelope or bag 12 adapted to be detachably fastened by so-called snaffle hooks 14 to a chest belt 16 which encircles the chest of the wearer below his shoulders and armpits. The belt 16 has a buckle 18 by which its opposite ends are fastened together. The inflatable flotation envelope 12 in its dormant condition is held folded by a strap 20 provided with mating snap faeteners 22 and 24. It is provided with a tubular filling stem 26 equipped with a closure plug 28 and also with a flexible filling tube 30 with one end adapted to slip snugly over the tubular stem 26. The flexible tube 30 at its other end is adapted to be inflated by being held in the mouth of the wearer or by being filled with compressed gas in a manner described below.

Also fastened to the belt 16 is the lower end of an elongated open-topped container 32 (FIG. 2) having a pair of circumferentially-spaced ears 34 secured at its upper end. Fastened to the ears 34 are shoulder straps 36, each of which near its opposite end has a loop 38 through which the belt 16 passes. The container 32 has a closed bottom wall 40 with a central opening 42 for the passage of a pressure gauge 44 connected to the lower end of an elongated compressed gas cylinder or bottle 46 which is normally held by the container 32. The upper end of the gas cylinder or bottle 46 terminates in an elongated neck 48 with a reduced-diameter externally-threaded end 50 onto which is threaded the internally-threaded stern 52 of a Y-coupling 54 having oppositely-extending tubular arms 56 and 58 (FIG. 2).

The neck 48 is bored transversely to receive a rotary valve member 60 (FIG. 3) having its opposite end portions circumferentially grooved to rotatably engage the hollow cylindrical rotary valve casing 62. The rotary valve member 60 is bored transversely to its axis to provide a passageway 64 which opens or closes communication through the passageway 66 in the neck 48, according to the position of rotation of the rotary valve member 60.

Fixedly secured as by welding to the recesses 68 in the opposite ends of the rotary valve member 60 are the bent ends 70 of short parallel valve-operating arms 72 which in combination with the foregoing parts form a gas distribution valve, generally designated 74. The valve-operating arms 72 are adapted to fit into and telescope with parallel tubular float arms 76 and to be secured in the upper ends thereof by fasteners 78, such as screws. The lower ends of the float arms 76 are secured by clamps 80 to the upper side of a valve-operating float 82. The left-hand arm 56 of the Y-coupling 54 is adapted either to be closed by a plug 84 or connected to the upper end of the flexible envelope-inflating tube 30, as the wearer may desire. The opposite end 58 of the Y-coupling 54 is adapted to receive the lower end of a flexible tube 86, the upper end of which is connected to the lower end of a flexible inflatable bladder 88. Secured to the upper end of the bladder 88 is the stem 90 of an alarm whistle 92 which is buoyed up above the water by the bladder 88 when inflated (FIG. 5). In order to hold the flexible tube 86, bladder 88 and whistle 92 in their normally dormant inoperative positions, an offset bracket 94 in the form of a hook is welded or otherwise secured at its lower end to the lower portion of the container 32. In order to manually open the gas distribution valve 74, a cord or lanyard 96 in the form of a loop is adapted to extend over the head of the wearer and is connected at its lower end to a cross member 98 interconnecting the float arms 76.

In the operation of the invention, let it be assumed that the wearer has put on the automatically-inflatable life preserver 10 in the manner shown in FIG. 1 and has fastened the belt 16 beneath his armpits by the buckle 18, having first adjusted the shoulder straps 36 to satisfactory positions on the belt 16. Let it also be assumed that the compressed gas cylinder 46 has been installed in its container 32 with the pressure gauge 44 projecting downward therefrom to the aperture 42 in the bottom wall 40 thereof, and that an adequate pressure of air or oxygen within the gas cylinder or bottle 46 is indicated by the pressure gauge 44. Finally, let it be assumed that the wearer has decided to use the optional flotation envelope or bag 12 and has attached it to the belt 16 by the hooks 14. If, moreover, the wearer has had prior warning of the need for the flotation bag 12, he has exercised his option of inflating it by mouth through the flexible tube 30 or by compressed air or oxygen from the cylinder 46 after having attached the upper end of the tube 30 to the arm 56 of the Y-coupling 54, having of course removed the plug 84 therefrom and also having removed the plug 28 from the filling stem 26 and applied thereto the lower end of the filling tube 30. At this time, the bladder 88 and whistle 92 will be held in the dormant inoperative position shown in FIG. 1 by the bracket 94 on the container 32. The inner end of the tube 86, of course, has been attached to the arm 58 of the Y-coupling 54 during assembly.

If, now, an emergency occurs whereby the wearer is thrown into the water or is obliged to enter the water for any reason, the float 82 by reason of its buoyancy rises, swinging upward its arms 76 and with them the valve-operating arm 72, thereby opening the gas distribution valve 74. Compressed gas, such as air or oxygen, flows into the Y-coupling 54 and through its arm 56 and tube 30 into the flotation bag or envelope 12 if it has not already previously been inflated by the wearer, who thereafter assumes the position shown in FIG. 5. At the same time, compressed gas escapes through the right-hand arm 58 of the Y-coupling 54 and through the flexible tube 84 and bladder 88 into the whistle 92, thereby buoying up the whistle 92 above the water and sounding an alarm to passersby or other persons available to effect a rescue of the wearer.

I claim:

1. An automatically inflatable life preserver adapted to sustain the wearer thereof in the water, said life preserver comprising an inflatable flotation envelope of flexible gas-tight material, a life preserver attachment structure connected to said flotation envelope and adapted to extend over the wearer's shoulders and including means for detachably securing said structure to the wearer's body.

a compressed-gas-operated audible alarm device connected to said attachment structure, bladder means connected to said alarm device, said bladder means becoming inflated upon the immersion of said life preserver in the water and thereby buoying up said alarm device above the water such that said alarm device emits sounds directly above the water, a compressed gas supply assembly mounted on said attachment structure and connected to said flotation envelope, said gas supply assembly including a compressed gas tank unit adapted to contain a compressed gas and a normally-closed rotary gas distribution valve unit disposed between said compressed gas tank unit and said envelope and between said compressed gas tank unit and said alarm device and in communication with said envelope and also with said alarm device, said rotary gas distribution valve unit including a valve casing and a rotary valve member journaled in said casing and rotatable between closed and open positions respectively closing and opening gas flow from said compressed gas tank unit to said envelope and also to said alarm device, and a float device operatively connected to said rotary valve member and responsive to the immersion thereof in water to rotate said rotary valve member from its normally-closed position to its open position establishing compressed gas flow from said compressed gas tank unit through said gas supply assembly to said envelope and also to said alarm device whereby to inflate said envelope and said bladder means and sound said alarm device automatically upon immersion thereof.

* * * * *